US008670585B2

(12) United States Patent
Valtchev et al.

(10) Patent No.: US 8,670,585 B2
(45) Date of Patent: Mar. 11, 2014

(54) SPHERICAL SOUND SOURCE FOR ACOUSTIC MEASUREMENTS

(76) Inventors: Plamen Ivanov Valtchev, Sofia (BG); Dimitar Kirilov Dimitrov, Sofia (BG)

( * ) Notice: Subject to any disclaimer, the term of this patent is extended or adjusted under 35 U.S.C. 154(b) by 32 days.

(21) Appl. No.: 13/561,210

(22) Filed: Jul. 30, 2012

(65) Prior Publication Data

US 2014/0029781 A1 Jan. 30, 2014

(51) Int. Cl.
*H04R 25/00* (2006.01)

(52) U.S. Cl.
USPC ..... 381/342; 381/182; 381/186

(58) Field of Classification Search
USPC ..... 381/89, 335, 336, 337, 339–343, 160, 381/182, 186, 386, 387; 181/144, 145, 147, 181/152, 153, 199
See application file for complete search history.

(56) References Cited

U.S. PATENT DOCUMENTS

| | | | | | |
|---|---|---|---|---|---|
| 2,638,510 | A | * | 5/1953 | Brami | 381/341 |
| 3,435,910 | A | * | 4/1969 | Lahti | 181/152 |
| 3,500,953 | A | * | 3/1970 | Lahti | 181/151 |
| 5,673,329 | A | * | 9/1997 | Wiener | 381/160 |

* cited by examiner

*Primary Examiner* — Huyen D Le

(57) ABSTRACT

Spherical sound source comprising two coaxial loudspeakers and two mid-high frequency compression drivers. Low frequencies are radiated by the two low-frequency sections of the coaxial loudspeakers. Mid-frequencies 500 Hz-2000 Hz are radiated by the two mid-high frequency compression drivers. High-frequencies 2 kHz-10 kHz are radiated in the horizontal plane by the same mid-high frequency arrangement together with two compression drivers of the coaxial loudspeakers in each vertical direction. Identical drivers form three pairs. One driver from each pair is enclosed in one of two symmetrically opposite half-embodiments, spaced at predetermined distance to create a common radially expanding horn for the two mid-high frequency compression drivers. All loudspeakers share the same vertical axis of rotational symmetry. The two half-embodiments might be used as separate standalone spherically radiating sources when installed on hard surface. The invention is appropriate for sine-swept acoustic measurements and sound isolation measurements in high sound transmission class buildings.

10 Claims, 8 Drawing Sheets

SPHERICAL SOUND SOURCE FOR ACOUSTIC MEASUREMENTS

PRIOR ART

Omni directional sound sources currently used for acoustic measurements are known as comprising multiple wideband loudspeakers arranged in dodecahedron, semi-dodecahedron, or another multi-hedron arrangements, to our knowledge, up to 120-hedron. Dodecahedron loudspeaker enclosure unit is patented by George W. Siolis, U.S. Pat. No. D. 226,567 in 1973. Another example of a dodecahedral speaker system is illustrates in FIG. 1, US Patent 2005/0025319 A1 of Iwao Kawakami. These configurations are based on the superposition principle, presuming spreading of infinite number of infinitely small and infinitely wide-band isotropic point sources over a spherical surface in order to obtain spherical radiation. Even though this presumption might be true in the above mentioned case, in reality it is neither feasible nor practical. In practice, a reasonably sized spherical surface would normally accommodate 12 or so membrane loudspeakers, and interference between them starts from mid-frequency band upwards, modifying the overall radiation pattern uniformity. Furthermore, every individual loudspeaker membrane does not radiate spherically, as its axial directivity index increases with frequency, thus further worsening the overall sound source directivity performance.

Measurements, performed on an on-purpose build dodecahedron sound source sample, revealed strongly irregular, multi-lobe directivity response at mid and high frequency, whereby both lobe number and magnitude deviation increased with frequency. Quantitatively, this resulted in directivity factor rising trend, with values starting from 1 at lower frequencies, rising to 2 at about 1 kHz, and abruptly thereafter. At 4 kHz, directivity factor value of about 12 (Directivity Index=10.8 dB) could be measured, whereby this figure depended on individual loudspeaker's high frequency directivity response. This dodecahedron was built for comparison, and has the typical dimensions of 38 cm between any opposite pentagonal faces. Two particular planes of polar pattern measurements were found, any of them revealing unexpectedly wide directional SPL deviation of 8 dB and 11 dB for 2 kHz and 4 kHz octave band center frequencies respectively. These figures were read by a very simple, moreover a single analog instrument polar pattern measurement, using a turntable, where lobe availability at any frequency or frequency band is clearly visible.

Dodecahedron sound source, unluckily, is characterized by its unsymmetrical mid-high frequency directivity pattern in whatsoever plane of measurement, and planes of maximum SPL deviation could not be intuitively found.

Defining acceptable deviations from omni-directionality for acoustic measurement sound sources, ISO-3382 standard states for frequency resolution an octave band limited pink noise excitation signal, and received signal averaging over "gliding" 30 deg arc in a free sound field is required. This angular resolution refer to as "gliding" (arcs, averages), is vague and actually consists in replacement of all angular variations within a 30° range by a single averaged value. Accordingly, a table has been set up to establish the acceptable deviation from the so called "omni-directionality" with the frequency, requiring ±1 dB limits for octaves centered on 125 Hz, 250 Hz and 500 Hz, and widening these limits up to ±6 dB for the octave centered on 4 kHz.

Such measurement procedure will definitely conceal the directivity diagram lobes in some important directions, which directions are in fact reference values for the directivity factor definition itself.

For precision acoustic measurement, however, concealing the actual sound source directivity performance couldn't help much. The results of measurements might turn to be misleading anyway.

Spherical sound source should be created not only to comply with ISO-3382 standard, but to exhibit a real spherical diagram, with the directivity factor very close to the theoretical minimum of 1 throughout the measurement spectrum. This cannot be achieved under conditions of interference, as the case is when multihedron loudspeaker arrangement is used, because just these interferences raise the directivity index value. Consequently, another hardware solution should be sought for, using completely new approach, differing from the superposition principle. Such hardware solution, using as few axial loudspeaker drivers as possible concentrated as close as possible to a single point, and having rotational and planar symmetry, is subject of this invention.

DESCRIPTION OF THE INVENTION

Provided is a spherical sound source with directivity factor very close to the theoretical minimum of 1 through the entire frequency band of measurements 50 Hz to 10 kHz (octave centers 63 Hz-8 kHz).

The geometrical base of the considerations will be a cylindrical co-ordinate system with reference Z-axis, referred to henceforth as vertical axis of rotational symmetry, and reference plane, perpendicular to this axis, with the origin of the system lying therein, referred to henceforth as horizontal symmetry plane.

Pursuing the object of the invention, proposed embodiments have both their acoustic and geometrical centers coinciding with the origin of said cylindrical coordinate system, have axial rotational symmetry with respect to the vertical axis, and have planar symmetry with respect to the horizontal symmetry plane.

To achieve rotational symmetry, all the loudspeaker components of described henceforth embodiments have been selected to have by design such symmetry, and are axially mounted, so that they have said vertical rotational symmetry axis as their own axis.

To achieve planar symmetry, all axially mounted drivers are grouped in three pairs, whereby each pair point of symmetry lies in the horizontal symmetry plane. Both drivers in each pair are located as close as possible each to the other and operate in monopole mode. Three adjacent drivers—one from each driver pair, have been further enclosed in an own appropriate enclosure and have yielded two identical half-embodiments, stackable symmetrically on both sides of the symmetry plane. Each of said half-embodiments, placed on a hard board (room floor, ceiling, or wall), is radiating spherically in so obtained half space, exhibiting in said half space the same radiation pattern as if there were two such half-embodiments operating together in full space. In this way, another object of the present invention is achieved—to design an embodiment made of two identical halves, with the option of stacking them together.

More specific object of the present invention is to divide the whole audio spectrum in 3 bands (low, mid-high, and high) and to allocate each one to one loudspeaker pair.

Another specific object of the present invention is to utilize high sensitivity horn-loaded compression drivers with high power capabilities for mid and high frequencies, letting direct radiating loudspeakers to be used for low frequencies only, where horn-loading is impractical.

FIG. 2A shows an exploded partial cross-sectional view of the arrangement of the loudspeakers commented on heretofore. The same, but unexploded, view is shown on FIG. 2B.

The closest to the symmetry plane pair, henceforth referred to as mid-high frequency compression driver pair 14, has its drivers turned face to face and operated in push-push mode, and radiates into a throat of a common radially expanding horn.

Two coaxial loudspeakers 10, turned back to back each to the other and placed possibly closest to the aforementioned pair, contain the other two pairs. One of them is the pair of low frequency membrane parts 11 of these loudspeakers, and the other one is the pair of their high frequency compression drivers 12. The sound radiating apertures of the latter two pairs are oppositely oriented along the vertical symmetry axis.

The membrane loudspeakers, fixed on individual closed box enclosures 16, radiate as if mounted on both ends of a cylinder and have subcardioid individual directivity patterns. Operated parallel in phase, they form together symmetrical spherical radiation diagram for any octave within the operational frequency band 50 Hz to about 500 Hz.

Both high frequency compression drivers 12 of the coaxial loudspeakers 10 radiate in substantially conical space of about 90 degrees opening angle, defined by membrane cones 11, which is equivalent to about $\pi/2$ solid angle spherical radiation.

BRIEF DESCRIPTION OF THE DRAWINGS

The invention will be better understood and other advantages of the invention will become more clearly apparent in the light of the following description and with reference to the appended drawings, in which.

DRAWING NUMERALS

Figure 1:
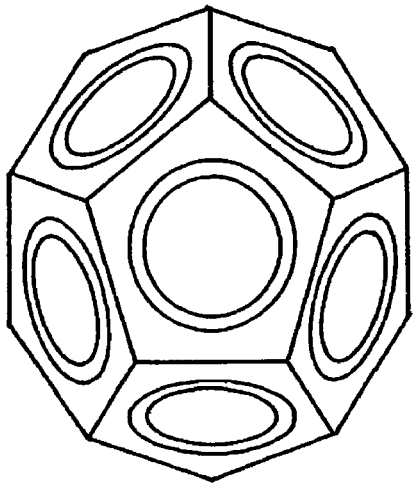
FIG. 1 PRIOR ART
FIG. 1 is a prior art illustration of a dodecahedron omnidirectional sound source [U.S. Pat. Des. 226,567]
Figure 2A:
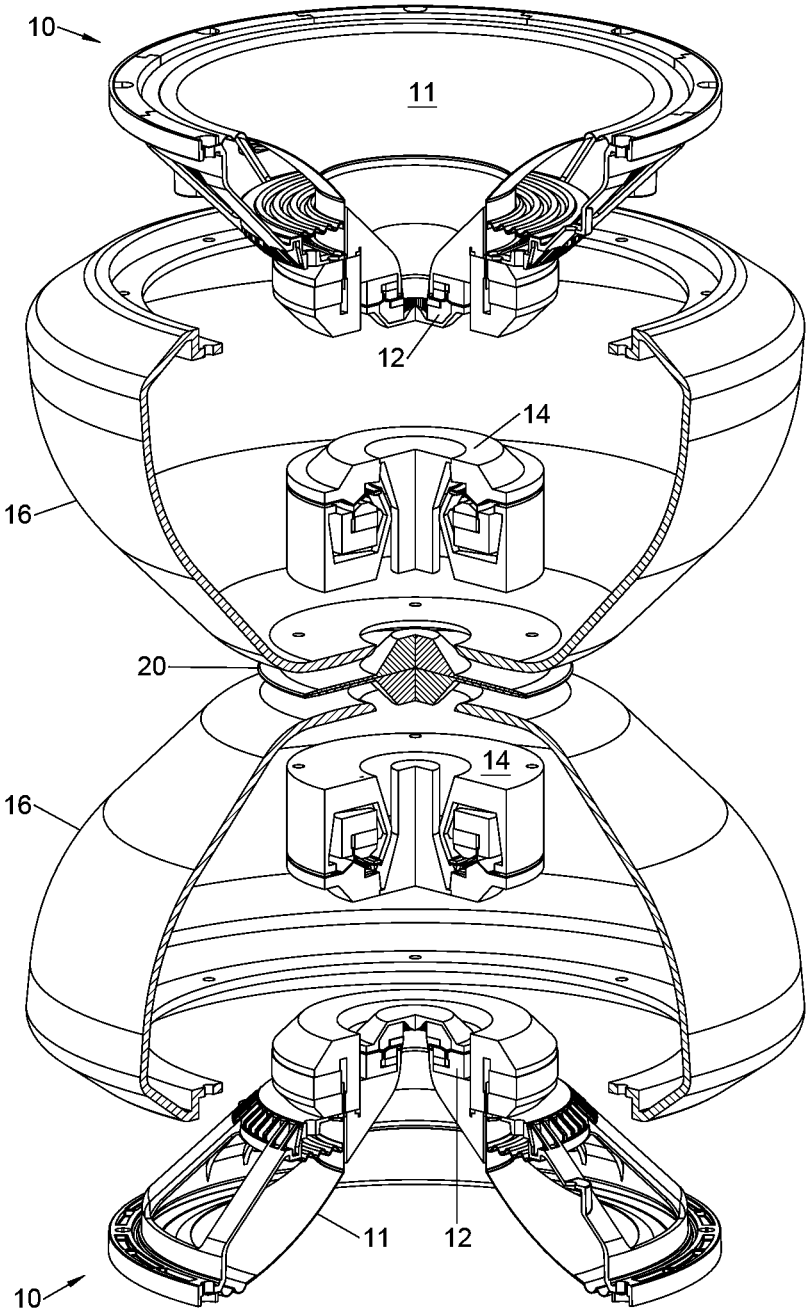
FIG. 2A is the exploded perspective cross-sectional schematic view of the spherical sound source intended for acoustic measurements.
Figure 2B:
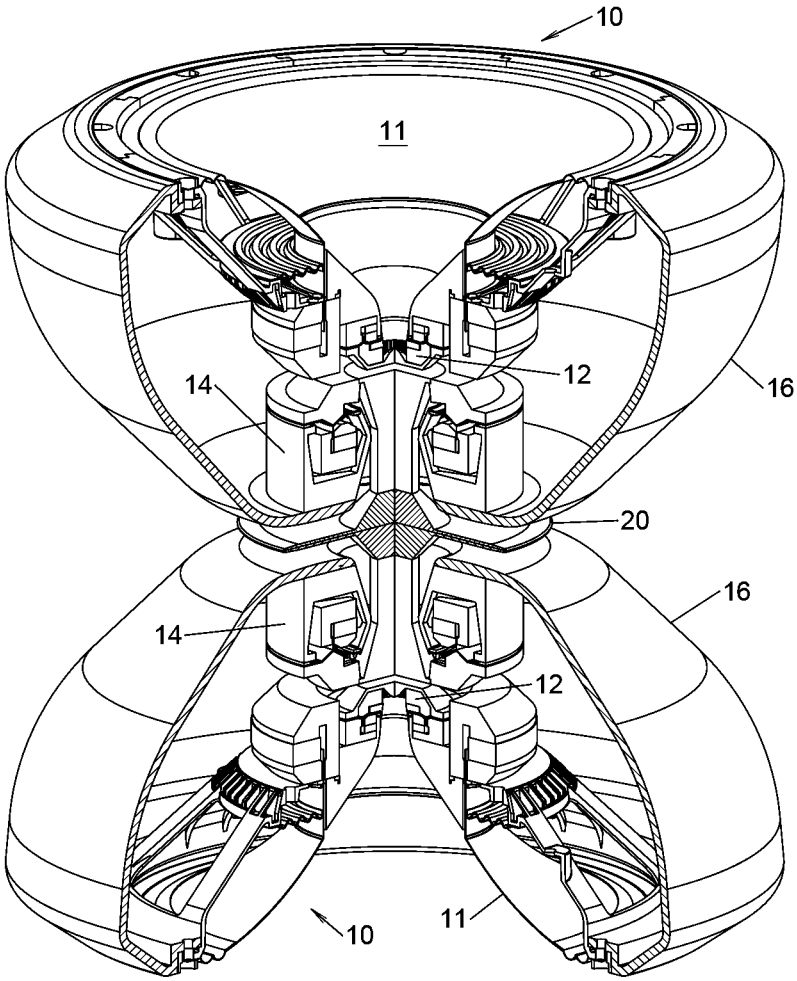
FIG. 2B is the perspective cross-sectional schematic view of the spherical sound source for acoustic measurements.

10—Coaxial loudspeaker
11—Low-frequency membrane loudspeaker—part of the coaxial loudspeaker
12—High frequency compression driver of the coaxial loudspeaker
14—Mid-high frequency compression driver
16—Enclosure
20—Circular plate
22—Horn shaping ceiling disc
24—Floor
28—Ceiling

DESCRIPTION OF THE FIRST EMBODIMENT

The embodiment comprises two low-frequency/high-frequency coaxial loudspeakers 10, two mid-high frequency compression drivers 14, and two enclosures 16. The loudspeakers are fixed correspondingly at the larger and the smaller openings of the enclosures 16, together with which they make up two low frequency closed box arrangements of the embodiment. The enclosure necessary wall thickness depends strongly of its material's mechanical properties, and in case of fiber glass composite 6 mm thickness has proved to be fully adequate.

Enclosure side walls are generated as a surface of revolution with the curvature of the surface being defined in its initial extension by a hyperexponential formula. This initial part, starting from the output of the mid-high frequency compression driver 14, defines together with a circular plate 20 said hyperexponential horn expansion in radial direction. The middle section, being a substantially straight line segment, defines the vertical mid-high frequency horn semi-radiating angle, which is about 45 degrees, thus making up about 90 degrees total radiating angle. The last extension section is additionally flared outwardly near the mouth of the horn to provide improved mid-range directivity control.

The two half embodiments are stacked together, symmetrically with respect to the circular plate 20, at predetermined distance by a plurality of support members fixed trough said circular plate. On said plate's both sides, substantially conical frusta are centrally attached, shaping the space to the compression driver output center, as means of coherent sound summing into the horn throat. Said circular plate could be made by two identical halves, each fixed to respective half-embodiment by a plurality of support members, with means of stacking the two halves one to the other.

The low frequency band 50 Hz to about 500 Hz is radiated by both low frequency membranes 11 of the coaxial loudspeakers 10, operating in monopole arrangement. With typical 100 dB,W,m sensitivity, and 1200 W electrical power, this configuration provides sound power levels above 130 dB re 1 pW with some 3 to 6 dB peak headroom.

Within 500 Hz-10 kHz audio spectrum band, two horn loaded mid-high frequency compression drivers 14 in push-push configuration are employed. This sound source configuration radiates spherically from 500 to 2 kHz. For higher frequencies, the radiation pattern starts resembling a reference ellipsoid. With typical sensitivity of 110 dB,W,m and typical power handling level of 250 Wrms, this configuration is capable of producing SPL above 134 dB/1 m, or more than 136 dB SWL (sound power level) re 1 pW.

A perfect time alignment between low frequency and mid-high frequency configurations within the interference zone is achieved by applying adjustable delay to both LF membrane driving signals, the virtual effect of which is as if they both are shifted inwards, towards the center of the sphere. If the delay corresponds to L/2 (where L=membrane to membrane distance), the LF monopole might be considered as virtual point source with reference to mid frequency drivers.

Figure 5:
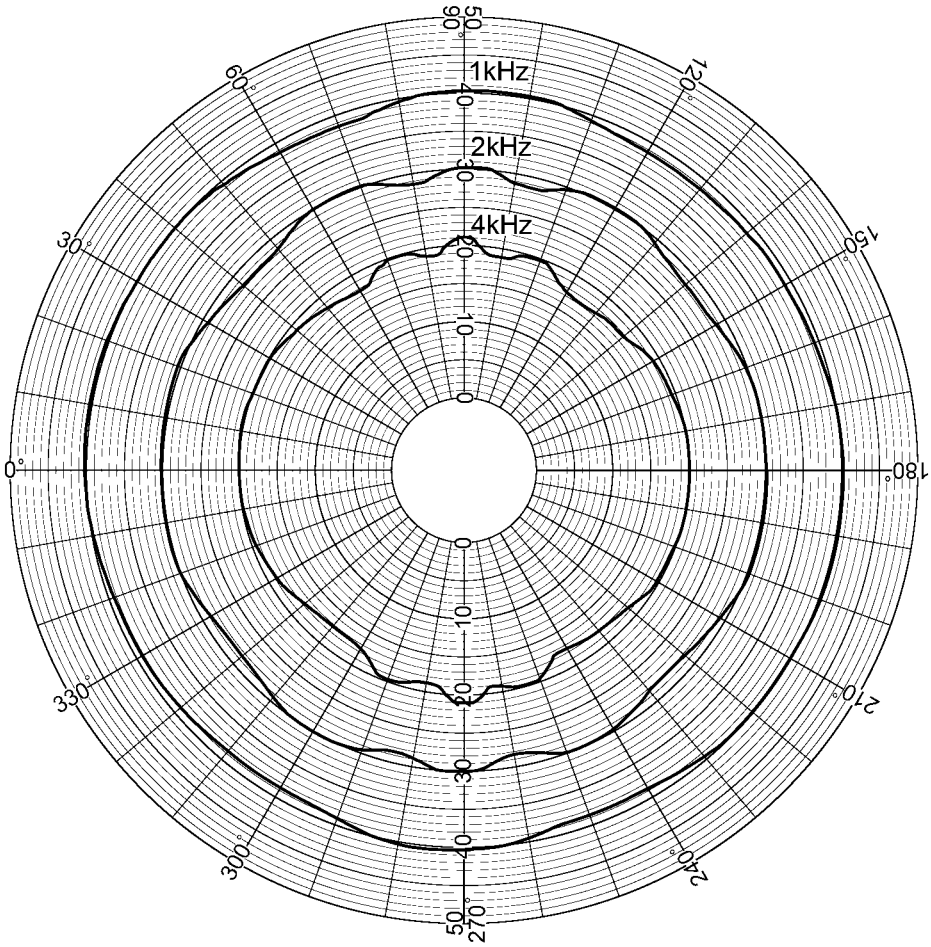
FIG. 5 illustrates spherical sound source polar patterns measured in vertical symmetrical plane with 1/1 octave band filtered pink noise signal in free field, for 1 kHz, 2 kHz and 4 kHz octave center frequencies.
Figure 6A:
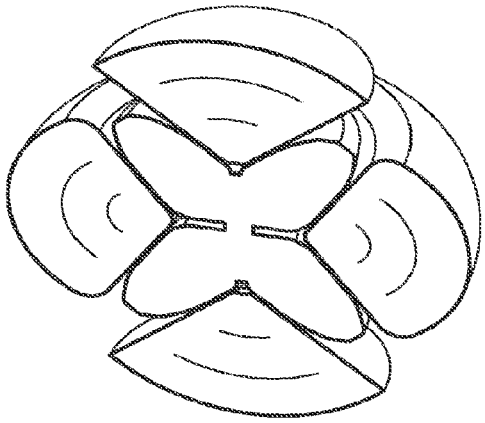
FIG. 6A illustrates the perspective partially cross-sectional view of a horizontal reference ellipsoid-like radiation pattern of the mid-high frequency compression drivers, and a vertical bi-conical radiation pattern of the high frequency compression drivers embedded in the coaxial loudspeakers.
Figure 6B:
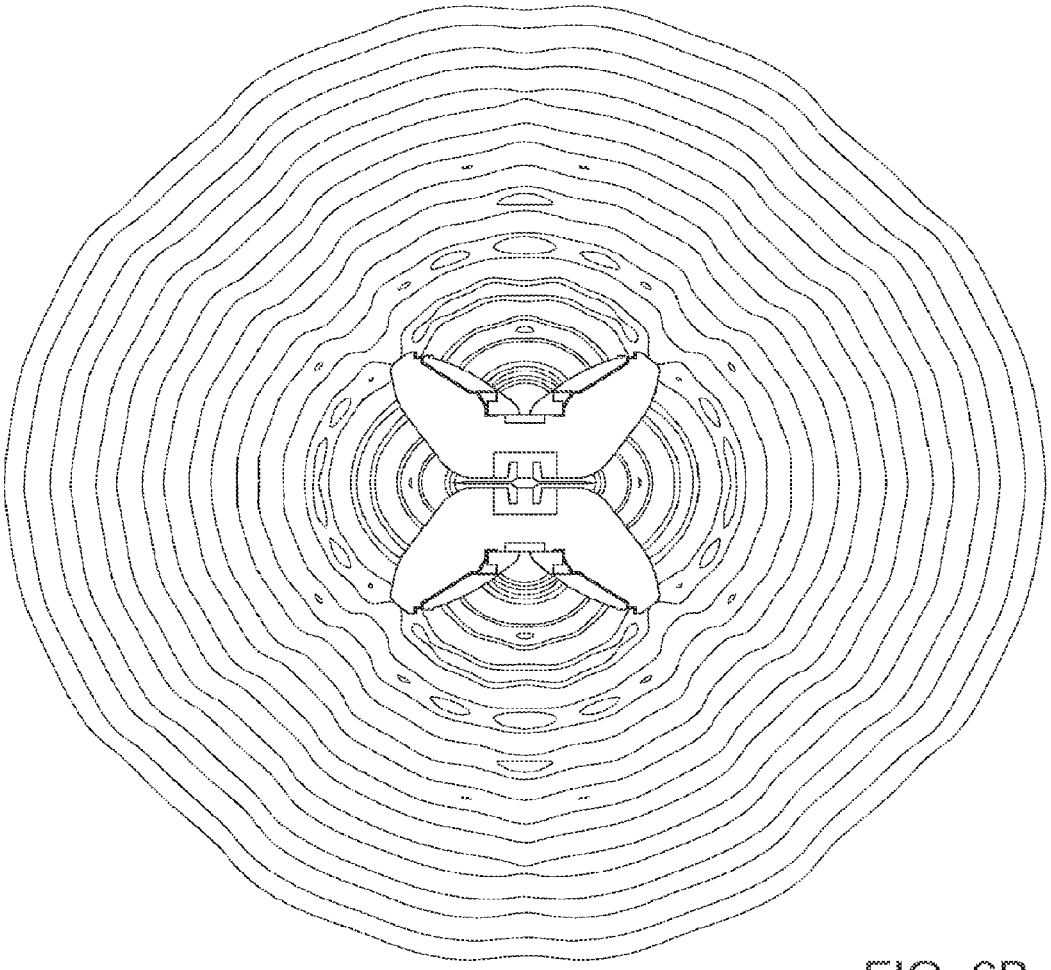
FIG. 6B illustrates combined polar pattern achieved by superposition of the two radiations from FIG. 6A in any arbitrarily vertical plane through the sound source axis, which is valid for 4 kHz frequency band.

From frequency 2 kHz upwards, additionally to the horizontally radiating mid-high frequency compression driver pair, the two high frequency compression drivers of the coaxial loudspeakers are activated—one for each $\pi/2$ vertical partial conical space. With a typical sensitivity of 112 dB,W, m, power handling of 50 $W_{rms}$, and ±45 Deg dispersion, adequate summing with mid-high frequency configuration is achieved. Spherical radiation of the high frequency band is achieved by superposition of a horizontal reference ellipsoid radiation pattern of the mid-high frequency compression drivers, and a vertical bi-conical radiation pattern of the high frequency compression drivers embedded in the coaxial loudspeakers. The two individual radiation patterns are illustrated as a 3D perspective partially cross-sectional view in FIG. 6A, and the combined polar pattern achieved by superposition of the two in any arbitrarily vertical plane through the sound source axis is illustrated in FIG. 6B, which is valid for 4 kHz frequency. Quite good agreement with the measurements is obvious if FIG. 6B illustration is compared to the 4 kHz octave measured polar pattern in FIG. 5B—the innermost curve.

Precise time alignment between high frequency and mid-high frequency signals in the interference zone is obtained by applying adjustable delay to the high frequency signal. Should the delay correspond to H/2 (where H is high-frequency compression driver's membrane to membrane distance), the high-frequency monopole might again be considered as virtual point sound source with respect to the mid-high frequency compression drivers. All in all, the tree radiating pairs—low frequency monopole, mid-high frequency push-push configuration and high frequency monopole, might be thought of as having coincident acoustic centers, further coinciding with the physical sound source center.

The so described embodiment is intended to be used for acoustic parameter measurements in architectural acoustics, and for sound isolation measurements in building acoustics.

DESCRIPTION OF THE SECOND EMBODIMENT

Figure 3A:
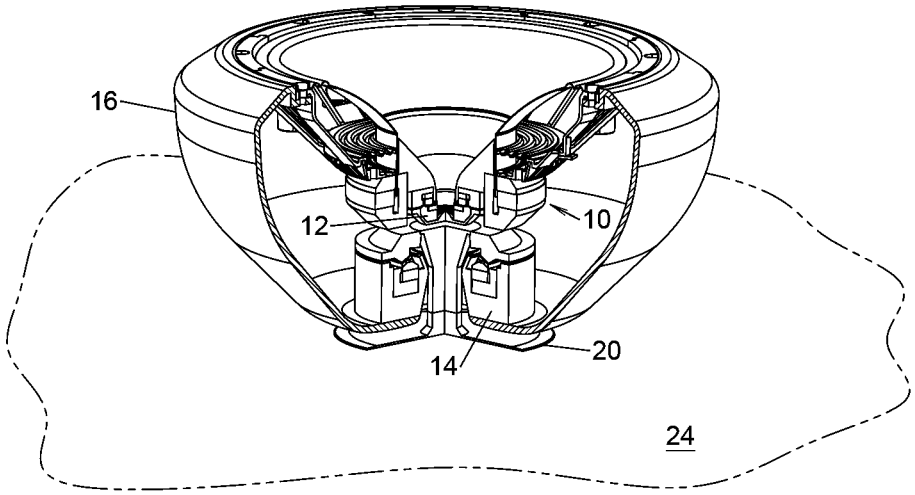
FIG. 3A is the perspective partially cross-sectional schematic view of one half of the spherical sound source for acoustic measurements.
Figure 3B:
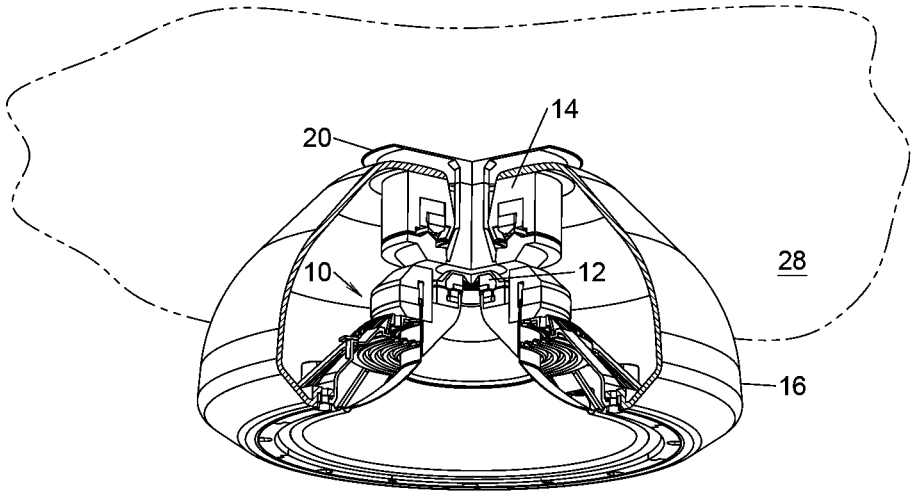
FIG. 3B is the perspective partially cross-sectional schematic view of one half of the spherical sound source mounted on ceiling for public address sound reinforcement.

The second embodiment, being the half of the first embodiment, is illustrated on FIG. 3A as an acoustic measurement sound source, mounted on floor. FIG. 3B illustrates the same embodiment, used for speech and music reinforcement and sound reproduction, mounted on a ceiling. The embodiment comprises one coaxial loudspeaker 10, mounted on enclosure 16, behind which a mid-high frequency compression driver 14 is fixed on a small opening of the enclosure. Mid-high frequency radially expanding horn is obtained between a substantially circular plate 20 mounted on floor 24 or ceiling 28 and enclosure's outer walls in driver's vicinity. Further, the hard floor or ceiling is used as one of the horn flares. Each spherical sound source half, mounted together with the circular plane half on a hard floor, or on any flat hard surface, is operated individually as spherical sound source in so obtained half spherical space. As in the first embodiment, low frequencies from 50 Hz to about 500 are radiated spherically by the low frequency membrane 11, mid-high frequencies are radiated by mid-high frequency compression driver 14, spherically up to 2000 Hz and resembling a reference ellipsoid afterwards, where the high frequency compression driver 12 is additionally activated, thus completing the combined high frequency directivity diagram to a spherical one. Just like in the first embodiment, spherical radiation of the high frequency band, under the new half spherical space conditions, is achieved by superposition of a horizontal reference ellipsoid radiation pattern of the mid-high frequency compression driver, and a vertical conical radiation pattern of the high frequency compression driver embedded in the coaxial loudspeaker.

Figure 3C:
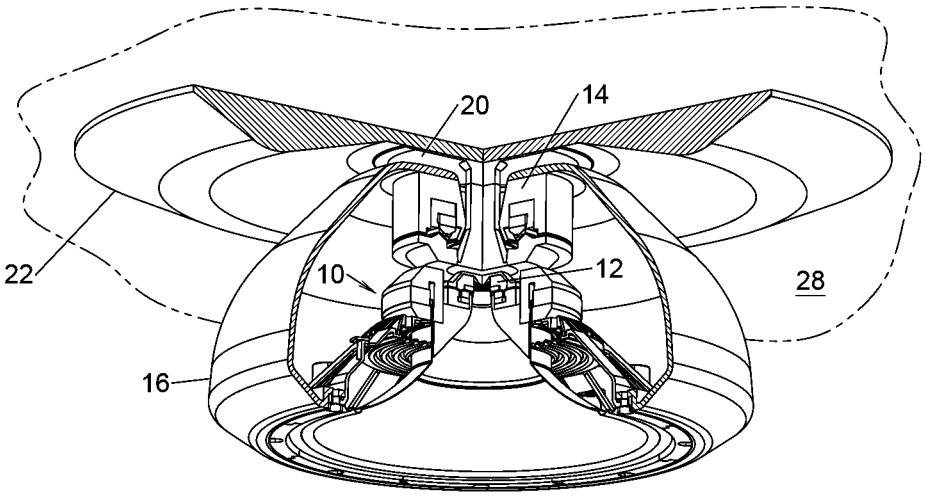
FIG. 3C is the perspective partially cross-sectional schematic view of one half of the spherical sound source for public address sound reinforcement, with additional horn shaping ceiling profile.

The easiest and most efficient way of sound reinforcement in conference halls, small size low ceiling sport arenas and other places where the public is assembled in circle, is to use a single loudspeaker cluster. Using in such places the second embodiment of this invention ensures uniform sound coverage of the circular audience area without the typical of the loudspeaker clusters interferences between adjacent loudspeakers in the cluster, and results in much better speech intelligibility. The ceiling version illustrated in FIG. 3B could be modified by introducing a horn shaping ceiling disc 22 shown on FIG. 3C. This ring may vary in shape to ensure proper coverage of audience periphery, without wasting diffused field energy towards empty areas.

Figure 4:
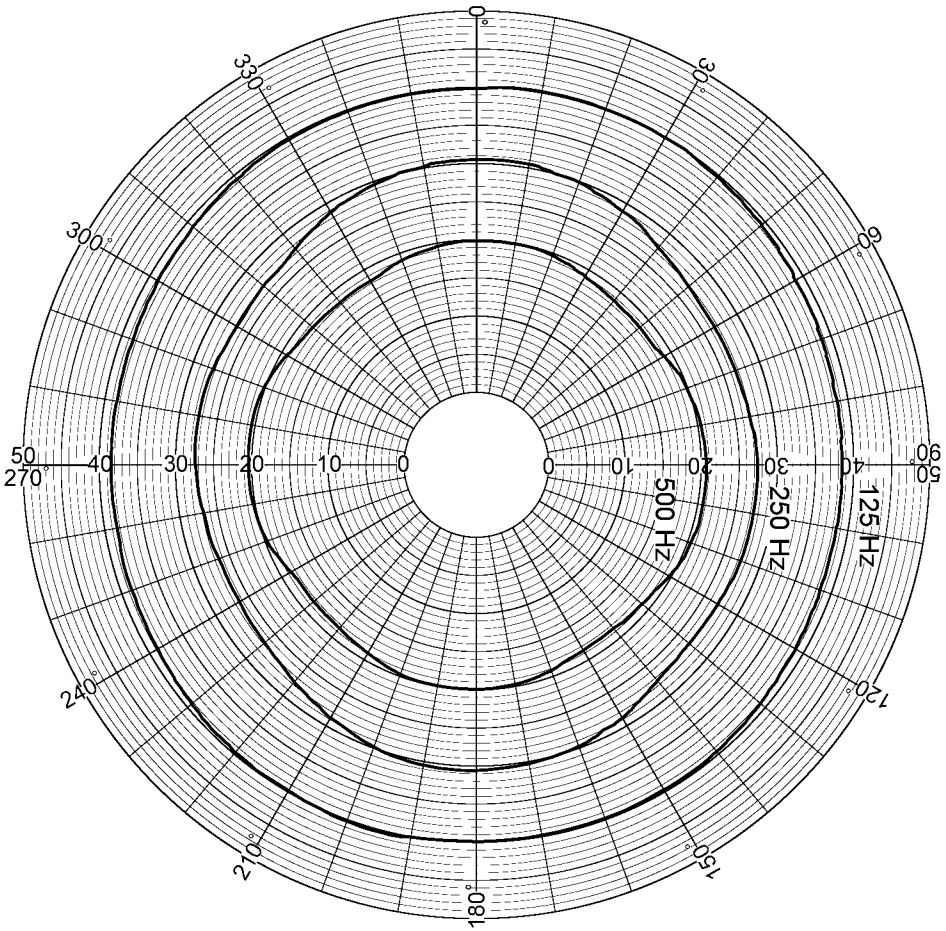
FIG. 4 illustrates spherical sound source polar patterns measured in vertical symmetrical plane with 1/1 octave band filtered pink noise signal in free field, for 125 Hz, 250 Hz and 500 Hz octave center frequencies.

Vertical polar patterns of the spherical sound source have been measured under free field conditions using 1/1 octave filtered pink noise signal. FIG. 4 illustrates the polar patterns for octave center frequencies 125 Hz, 250 Hz and 500 Hz and FIG. 5 shows polar patterns measured in 1 kHz, 2 kHz and 4 kHz octave bands. Due to the rotational symmetry these polar patterns are sufficient to be used for high resolution 3-D polar pattern construction for any standard octave frequency band.

From measured polar patterns shown, rotational and planar symmetry of the spherical sound source are obvious. Polar patterns for 2 kHz and 4 kHz exhibit unique evenness with maximum directional SPL deviation of 2 dB and 4 dB respectively. The purposely build dodecahedron sound source revealed much wider directional SPL deviation of 8 dB and 11 dB for the same 2 kHz and 4 kHz octave band center frequencies, which figures apply to any of the two particular planes of measurement.

Smoother directivity of the spherical sound source would provide better radiator for all acoustic parameter measurements than widely accepted dodecahedrons, especially for those spacious parameters which are very sensitive to directivity performance of the sound source.

The measured sound power level (SWL) figures of the spherical sound source of more than 134 dB at all usable frequency band 50 Hz-10 kHz are far beyond the reach of any known multihedron available on the market.

While above description contains many specificities, these should not be construed as limitations on the scope, but rather as an exemplification of the first embodiment. Many other variations are possible. For example, switching off high-frequency vertically radiating horns during acoustic measurements, although giving less uniform octave band radiation, might have more uniform frequency response in horizontal plane, hence, more precise spacious parameters measured. It should be pointed out that even with vertical high-frequency radiation switched off, spherical sound source complies with ISO-3382 specification, so such measurements would be accepted. Some embodiments might utilize coaxial mid-high frequency compression drivers, instead of the single band ones used in radially expanding horn between the two half-embodiments. Crossover frequency between low-frequency and mid-high frequency drivers may vary from 200 Hz to 500 Hz or even wider. Vertical radiation angle of mid-high frequency radial horn, formed by the two half embodiment, might vary between 40 degree and 60 degree or wider. The vertically radiating high-frequency coaxial drivers might have even wider range of membrane cone angles than mentioned 45 degree, or even they might use their own horns in front of the membranes.

What is claimed is:

1. Spherical sound source, comprising:

a. two substantially identical enclosures, said enclosures symmetric with respect to a common horizontal, lying between them, plane of symmetry, and with respect to a common vertical axis of symmetry, said axis perpendicular to said plane of symmetry, whereby each enclosure sidewall is generated as a surface of revolution around said vertical axis of symmetry with predetermined curvature of said surface and has two axial openings on both sides for loudspeaker mounting;

b. two coaxial loudspeakers, mounted in both opposite substantially circular openings of said enclosures, said coaxial loudspeakers closing with their low-frequency membranes enclosure volume as means of making up low frequency close box arrangement of each enclosure, and radiating axially high frequencies by their high-frequency compression drivers;

c. two mid-high frequency compression drivers, mounted at both other said openings of both said enclosures, so that said drivers' outputs radiate sound waves in phase each to the other into a common radially expanding horn, and said radially expanding horn is formed by said enclosure side walls.

2. The spherical sound source of claim 1, further including substantially circular plate of predetermined thickness, fixed symmetrically by a plurality of support members between said enclosures, with centrally attached on said plate's both sides substantially conical frusta as means of coherent sound summing into said common radially expanding horn.

3. The spherical sound source of claim 2, in which said circular plate is dividable by a horizontal plane of symmetry into two identical halves, as means of demountability of each of said halves from the other, whereby each spherical source half, mounted together with said circular plate half on a hard floor, or on any flat hard surface, is operated individually as spherical sound source in so obtained half spherical space.

4. The spherical sound source of claim 1, in which all used loudspeaker drivers have their axes coinciding with the vertical axis of symmetry, have rotational symmetry with respect thereto, and are grouped into three pairs, whereby each said pair further has planar symmetry with respect to the horizontal plane of symmetry, and drivers in each pair operate in one of the three frequency bands—low frequency, mid-high frequency or high frequency band.

5. The spherical sound source of claim 4, in which the low frequency band is radiated by the outermost loudspeaker pair of outwards oriented low-frequency membrane loudspeakers, operated in monopole mode, as means to superimpose both individual subcardioid radiation patterns into a common spherical radiation diagram.

6. The spherical sound source of claim 4, in which the innermost pair of mid-high frequency compression drivers radiate spherically the mid frequency band.

7. The spherical sound source of claim 4, in which the spherical radiation of the high frequency band is achieved by superposition of a horizontal reference ellipsoid radiation pattern of the mid-high frequency compression drivers, and a vertical bi-conical radiation pattern of the high frequency compression drivers embedded in the coaxial loudspeakers.

8. Half Space Spherical sound source, comprising:

a. an enclosure with one small and one large substantially circular axial openings for loudspeaker mounting, said enclosure's sidewall generated as a surface of revolution around a vertical axis of symmetry with predetermined curvature of said surface;

b. a coaxial loudspeaker, mounted on the larger of said openings of said enclosure, said coaxial loudspeaker closing with its low-frequency membrane an enclosure volume as means of making up low frequency close box arrangement, and radiating axially high frequencies with its high-frequency compression driver;

c. a mid-high frequency compression driver, mounted on the smaller said opening of said enclosure, so that said driver's output radiates sound waves into a radially expanding horn, and said radially expanding horn is formed between said enclosure sidewall and the hard surface, on which the spherical sound source is fixed at a predetermined distance by means of a plurality of fixing members.

9. The sound source of claim 8, further including substantially circular plate of predetermined thickness, fixed between said enclosure and the hard surface by a plurality of support members, with centrally attached on said plate's side, facing the enclosure, substantially conical frustum, the latter folding sound wave propagation into the throat of said radially expanding horn.

10. The sound source of claim 9, further including a substantially circular horn shaping ceiling disc of predetermined profile, axially mounted on said hard surface between the enclosure and said hard surface, as means of improving directivity towards the audience.

* * * * *